US011424065B2

(12) United States Patent
Yoon et al.

(10) Patent No.: US 11,424,065 B2
(45) Date of Patent: Aug. 23, 2022

(54) COIL ELECTRONIC COMPONENT

(71) Applicant: SAMSUNG ELECTRO-MECHANICS CO., LTD., Suwon-si (KR)

(72) Inventors: Chan Yoon, Suwon-si (KR); Dong Hwan Lee, Suwon-si (KR); Dong Jin Lee, Suwon-si (KR); Young Ghyu Ahn, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 527 days.

(21) Appl. No.: 16/285,742

(22) Filed: Feb. 26, 2019

(65) Prior Publication Data

US 2020/0105455 A1 Apr. 2, 2020

(30) Foreign Application Priority Data

Sep. 28, 2018 (KR) ..... 10-2018-0115635

(51) Int. Cl.

| | |
|---|---|
| ***H01F 27/24*** | (2006.01) |
| ***H01F 27/28*** | (2006.01) |
| ***H01F 27/29*** | (2006.01) |
| ***H01F 27/02*** | (2006.01) |

(52) U.S. Cl.

CPC ..... *H01F 27/2804* (2013.01); *H01F 27/022* (2013.01); *H01F 27/29* (2013.01); *H01F 27/24* (2013.01); *H01F 2027/2809* (2013.01)

(58) Field of Classification Search

CPC .... H01F 27/2804; H01F 27/29; H01F 27/022; H01F 27/24; H01F 2027/2809; H01F 27/34; H01F 2017/048; H01F 17/0013; H01F 17/04; H01F 3/10; H01F 27/292; H01F 27/255; H01F 27/323; H01F 2017/002; H01F 2017/0066

See application file for complete search history.

(56) References Cited

U.S. PATENT DOCUMENTS 6,459,351 B1 * 10/2002 Maki ..... H01F 27/2804 336/200
6,515,568 B1 * 2/2003 Maki ..... H01F 3/10 336/200

(Continued)

FOREIGN PATENT DOCUMENTS

CN 1282968 A 2/2001
CN 105825994 A 8/2016

(Continued)

OTHER PUBLICATIONS

Office Action dated Jun. 16, 2022, issued in corresponding Chinese Patent Application No. 201910499773.1.

*Primary Examiner* — Mang Tin Bik Lian
(74) *Attorney, Agent, or Firm* — Morgan, Lewis & Bockius LLP

(57) ABSTRACT

A coil electronic component includes first and second coil portions magnetically coupled to each other, an intermediate layer disposed between the first and second coil portions and including first magnetic particles, and an encapsulant encapsulating the first and second coil portions and including second magnetic particles. The intermediate layer and the encapsulant have permeabilities different from each other.

19 Claims, 4 Drawing Sheets

(56) References Cited

U.S. PATENT DOCUMENTS

| | | | | |
|---|---|---|---|---|
| 7,446,638 | B2 * | 11/2008 | Nogi | H01F 3/14 336/200 |
| 8,198,972 | B2 * | 6/2012 | Akazawa | H01F 17/0013 336/200 |
| 9,349,525 | B2 * | 5/2016 | Jeong | H01F 27/2804 |
| 9,812,247 | B2 | 11/2017 | Jeong | |
| 10,978,238 | B2 | 4/2021 | Yoshioka et al. | |
| 2003/0134612 | A1 * | 7/2003 | Nakayama | H01F 17/0013 455/307 |
| 2007/0030659 | A1 * | 2/2007 | Suzuki | H01F 17/0013 361/793 |
| 2013/0293216 | A1 * | 11/2013 | Yokoyama | H01F 17/0013 323/355 |
| 2014/0266551 | A1 * | 9/2014 | Yokoyama | H01F 27/25 336/200 |
| 2016/0078997 | A1 | 3/2016 | Son et al. | |
| 2016/0217903 | A1 | 7/2016 | Jeong | |
| 2016/0217917 | A1 * | 7/2016 | Jeong | H01F 27/292 |
| 2017/0006706 | A1 | 1/2017 | Yoon et al. | |
| 2017/0196091 | A1 | 7/2017 | Lee | |
| 2017/0345551 | A1 * | 11/2017 | Yoshioka | H01F 17/0013 |
| 2018/0061561 | A1 | 3/2018 | Sim et al. | |
| 2018/0254139 | A1 * | 9/2018 | Yazaki | H01F 27/24 |
| 2019/0131063 | A1 * | 5/2019 | Arai | H01F 27/346 |

FOREIGN PATENT DOCUMENTS

| | | | |
|---|---|---|---|
| CN | 105825996 | A | 8/2016 |
| CN | 107452492 | A | 12/2017 |
| JP | 10-270256 | A | 9/1998 |
| KR | 10-2017-0004121 | A | 1/2017 |

* cited by examiner

COIL ELECTRONIC COMPONENT

CROSS-REFERENCE TO RELATED APPLICATION(S)

This application claims the benefit of priority to Korean Patent Application No. 10-2018-0115635 filed on Sep. 28, 2018 in the Korean Intellectual Property Office, the disclosure of which is incorporated herein by reference in its entirety.

TECHNICAL FIELD

The present disclosure relates to a coil electronic component.

BACKGROUND

As the miniaturization and thinning of various electronic devices, such as digital televisions (TVs), mobile phones, laptop computers, and the like, have accelerated with the development of information technology (IT), coil electronic components applied to such electronic devices have also been required to be miniaturized and thinned. To satisfy such a requirement, research into winding type or thin film type coil components having various shapes has been actively undertaken.

A major issue, depending on the miniaturization and thinning of coil electronic components, is to implement the same characteristics as existing coil electronic components in spite of such miniaturization and thinning. In this regard, it is necessary to increase a ratio of a magnetic material in a core filled with the magnetic material. However, there is a limitation in increasing the ratio of the magnetic material due to strength of an inductor body, frequency characteristics variations depending on insulating properties, and the like.

On the other hand, there is an increasing demand for an array-type component having an advantage such as a reduction in a mounting area of a coil electronic component. Such an array-type coil electronic component may have a non-coupled or coupled inductor form, or mixture of non-coupled and the coupled inductor forms, depending on a coupling coefficient or mutual inductance between a plurality of coil portions.

In a coupled inductor, leakage inductance is associated with an output current ripple, and mutual inductance is associated with an inductor current ripple. In order for the coupled inductor to have the same output current ripple as an output current ripple of an existing non-coupled inductor, a leakage inductance of the coupled inductor should be the same as a mutual inductance of an existing non-coupled inductor. In addition, when mutual inductance is increased, a coupling coefficient k is increased, and thus, the inductor current ripple may be decreased.

Therefore, when the coupled inductor may have a decreased inductor current ripple while having the same output current ripple as the existing non-coupled inductor at the same size as the existing non-coupled inductor, efficiency of the inductor array may be increased without an increase in a mounting area. To improve the efficiency of an inductor array chip while maintaining a size of the inductor array chip, a coupled inductor, in which a coupling coefficient is increased by increasing a mutual inductance, is required. Meanwhile, a coupled inductor, in which a coupling coefficient is decreased depending on a need of application, is required in some cases. In such a case, a coupling coefficient between coil portions needs to be reduced to an appropriate level.

SUMMARY

An aspect of the present disclosure is to provide a coil electronic component, having a coupled inductor structure, in which coupling inductance between coil portions is effectively adjusted.

According to an aspect of the present disclosure, a coil electronic component includes first and second coil portions magnetically coupled to each other, an intermediate layer disposed between the first and second coil portions and including first magnetic particles, and an encapsulant encapsulating the first and second coil portions and including second magnetic particles. The intermediate layer and the encapsulant have permeabilities different from each other.

The permeability of the intermediate layer may be greater than the permeability of the encapsulant.

The permeability of the intermediate layer may be less than the permeability of the encapsulant.

The intermediate layer may include the first magnetic particles in a first volume fraction, where the first volume fraction refers to a volume ratio of the first magnetic particles with respect to a volume of the intermediate layer. The encapsulant may include the second magnetic particles in a second volume fraction, where the second volume fraction refers to a volume ratio of the second magnetic particles with respect to a volume of the encapsulant. The first and second volume fractions may be different from each other.

The first volume fraction may be greater than the second volume fraction, and the permeability of the intermediate layer may be greater than the permeability of the encapsulant.

The first volume fraction may be less than the second volume fraction, and the permeability of the intermediate layer may be less than the permeability of the encapsulant.

The first magnetic particles and the second magnetic particles may be metal alloys having the same composition.

The coil electronic component may further include first and second external electrodes, disposed on external surfaces of the encapsulant to be connected to both ends of the first coil portion, and third and fourth external electrodes disposed on external surfaces of the encapsulant to be connected to both ends of the second coil portion.

The first coil portion may have a structure in which a plurality of coil patterns are laminated.

An insulating layer may be interposed between the plurality of coil patterns of the first coil pattern, and the plurality of coil patterns of the first coil pattern may be connected to each other by at least one via.

The second coil portion may have a structure in which a plurality of coil patterns are laminated.

An insulating layer may be interposed between the plurality of coil patterns of the second coil pattern, and the plurality of coil patterns of the second coil pattern may be connected to each other by at least one via.

The encapsulant may include a first encapsulant, encapsulating the first coil portion, and a second encapsulant encapsulating the second coil portion.

The first and second encapsulants may have different permeabilities to each other.

The intermediate layer may have a shape dividing the encapsulant into two regions.

The intermediate layer may extend in a direction of external surfaces of the first and second coil portions in such a manner that side surfaces of the intermediate layer are exposed externally of the encapsulant.

The two regions of the encapsulant divided by the intermediate layer may be separate from each other.

The intermediate layer may be disposed in a region corresponding to a core region of the first and second coil portions.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
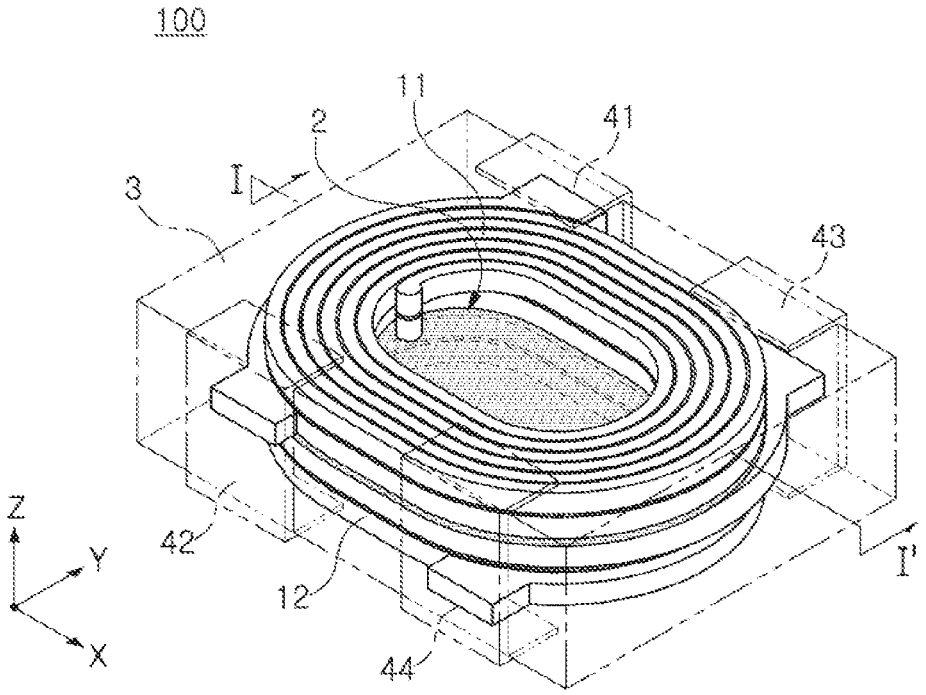
FIG. 1 is a perspective view of a coil electronic component according to an exemplary embodiment in the present disclosure.

Hereinafter, examples of the present disclosure will be described as follows with reference to the attached drawings.

The present disclosure may, however, be embodied in many different forms and should not be construed as being limited to the examples set forth herein. Rather, these examples are provided so that this disclosure will be thorough and complete, and will fully convey the scope of the present disclosure to those skilled in the art.

The same reference numerals are used to designate the same elements throughout the drawings. In the drawings, the sizes and relative sizes of layers and regions may be exaggerated for clarity.

Figure 2:
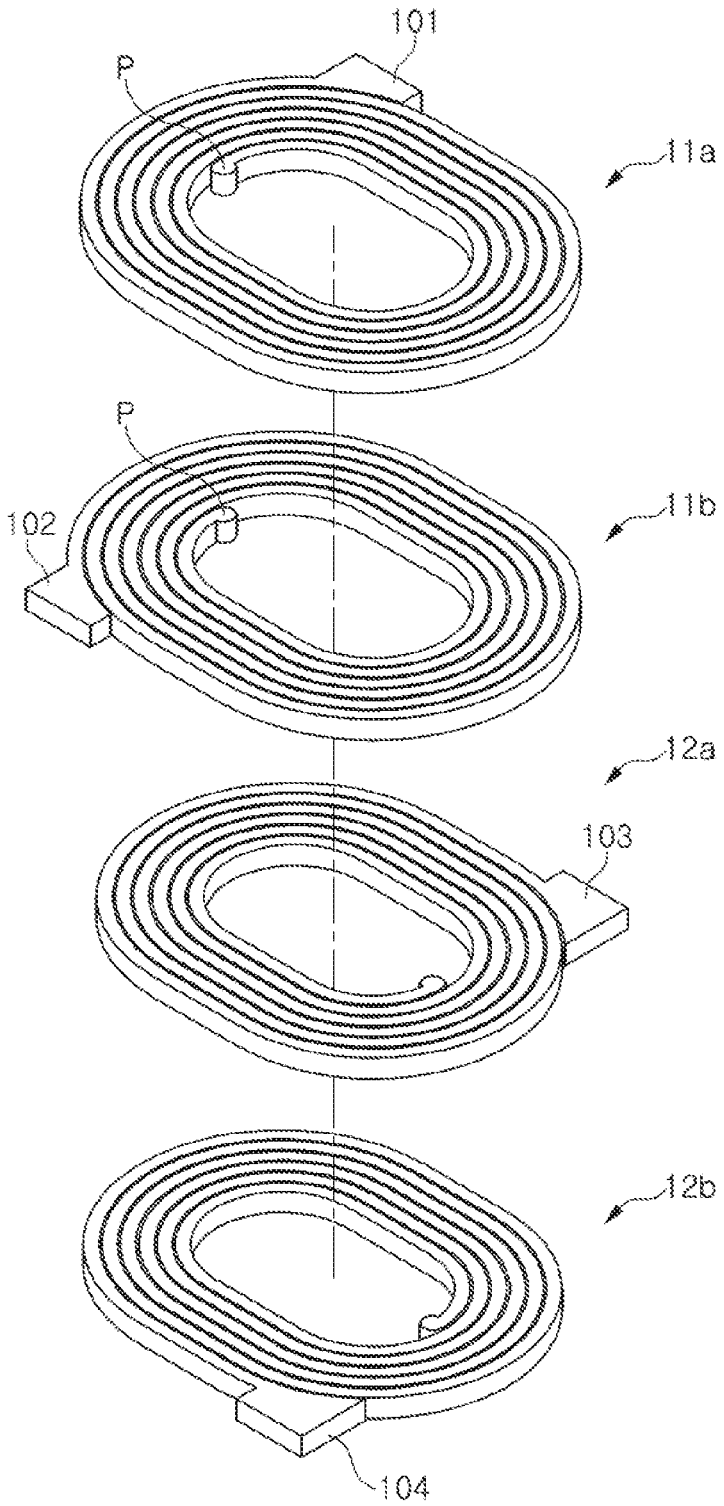
FIG. 2 is an exploded perspective view of coil portions included in the coil electronic component in FIG. 1.
Figure 3:
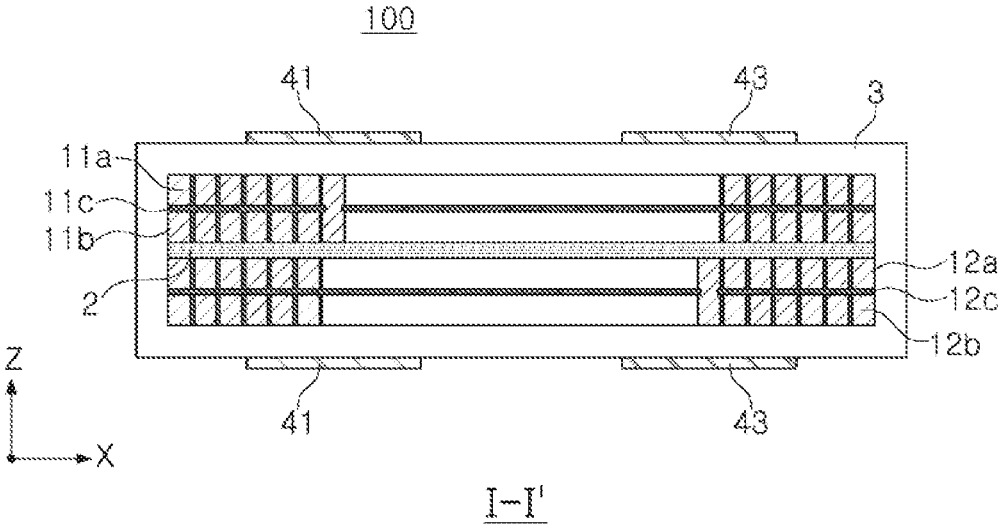
FIG. 3 is a cross-sectional view taken along line I-I' in FIG. 1.
Figure 4:
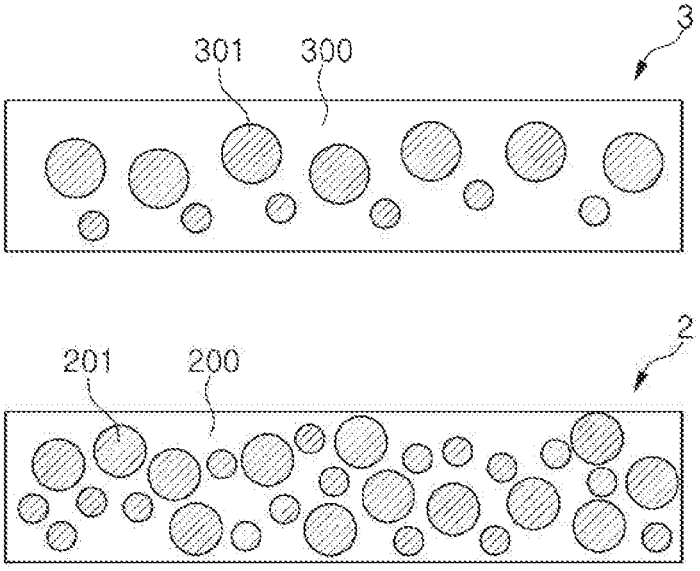
FIGS. 4 and 5 are cross-sectional views illustrating an intermediate layer and an encapsulant having different volume fractions for use in the coil electronic component in FIG. 1.
Figure 5:
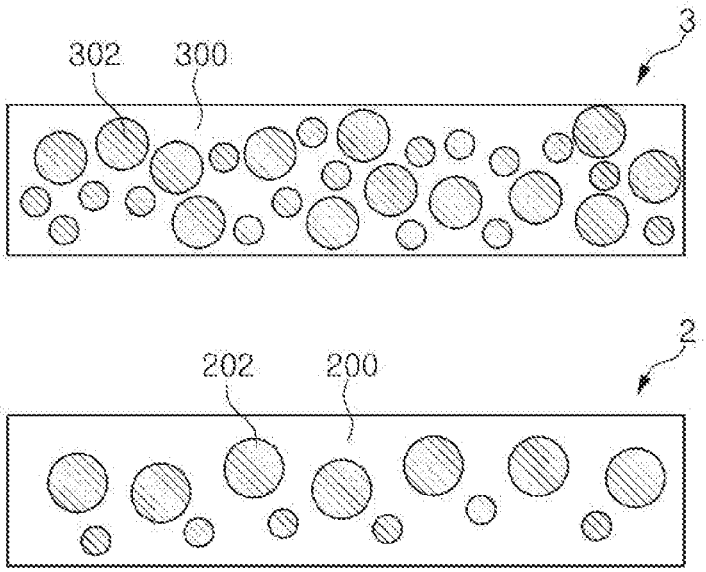

FIG. 1 is a perspective view of a coil electronic component according to an exemplary embodiment in the present disclosure. FIG. 2 is an exploded perspective view of coil portions included in the coil electronic component in FIG. 1, FIG. 3 is a cross-sectional view taken along line I-I' in FIG. 1, and FIGS. 4 and 5 are cross-sectional views illustrating an intermediate layer and encapsulant for use in the coil electronic component in FIG. 1.

Referring to FIGS. 1 to 5, a coil electronic component 100 according to an exemplary embodiment includes an intermediate layer 2, a first coil portion 11, a second coil portion 12, an encapsulant 3, external electrodes 105 and 106. The intermediate layer 2 and the encapsulant 3 each include magnetic particles and have different permeabilities to each other.

The intermediate layer 2 supports the first coil portion 11 and the second coil portion 12 and includes a magnetic material to affect magnetic coupling characteristics of the first and second coil portions 11 and 12. As illustrated in FIG. 4, the intermediate layer 2 includes first magnetic particles 201, and an insulating material 200 may be interposed between the first magnetic particles 201. Similarly, the encapsulant 3 includes second magnetic particles 301, and an insulating material 300 may be interposed between the second magnetic particles 301. The insulating material 200 of the intermediate layer 2 and the insulating material 300 of the encapsulant 3 may include an epoxy resin, a glass, or the like and may be identical to each other or different from each other.

The first coil portion 11 may have a spiral structure, disposed on one surface (an upper surface on the basis of drawings) of the intermediate layer 2, forming one or more turns. The first coil portion 11 may have a structure in which a plurality of coil patterns 11*a* and 11*b* are laminated to ensure a sufficient number of turns, and the plurality of coil patterns 11*a* and 11*b* may be connected to each other by vias. To this end, each of the coil patterns 11*a* and 11*b* may have a pad P. An insulating layer 11*c* may be interposed between the plurality of coil patterns 11*a* and 11*b*, and lead-out portions 101 and 102 may be provided to connect the external electrodes 41 and 42 to each other. In the present embodiment, two coil patterns 11*a* and 11*b* are used, but the number thereof may be changed.

In the same manner, the second coil portion 12 may have a helical structure, disposed on the other surface (a lower surface on the basis of drawings) to oppose the one surface at the intermediate layer 2, forming one or more turns. The second coil portion 12 may have a structure in which a plurality of coil patterns 12*a* and 12*b* are laminated to secure a sufficient number of turns. The plurality of coil patterns 12*a* and 12*b* may be connected to each other by a via. Each of the coil patterns 12*a* and 12*b* may have a pad P. An insulating layer 12*c* may be interposed between the plurality of coil patterns 12*a* and 12*b*, and lead-out portions 103 and 104 may be provided for connection to the external electrodes 43 and 44, respectively. In the present embodiment, similarly to the first coil portion 11, the second coil portion 12 includes two coil patterns 12*a* and 12*b*, but the number thereof may be changed.

As illustrated in FIG. 3, the first and second coil portions 11 and 12 may be magnetically coupled to each other to form a coupled-inductor structure. Further, the first and second coil portions 11 and 12 may share an axis of a magnetic core with each other. The first and second coil portions 11 and 12 may be formed by a plating process, such as a pattern plating process, an anisotropic plating process, an isotropic plating process, or the like. Each of the first and second coil portions 11 and 12 may be formed as a multilayer structure using a plurality of processes among the above-mentioned processes.

The encapsulant 3 encapsulates the first and second coil portions 11 and 12 and includes the second magnetic particles 301, as set forth above. The encapsulant 3 may be formed to expose lead-out portions 101, 102, 103 and 104 outwardly of the first and second coil portions 11 and 12.

A material forming the first magnetic particles 201 of the intermediate layer 2 and the second magnetic particles 3 of the encapsulant 3 may be, for example, ferrite, a metal or the like. In the case in which the material is a metal, the material may be, for example, an iron (Fe)-based alloy or the like. Specifically, the magnetic particles may be formed of a nanocrystalline alloy, an iron-nickel (Fe—Ni) alloy, or the like having an iron-silicon-boron-chromium (Fe—Si—B—Cr) composition. When the magnetic particles 201 and 301 are implemented using an Fe-based alloy or the like, they have improved magnetic characteristics such as magnetic permeability but may be vulnerable to electrostatic discharge (ESD). Accordingly, the above-mentioned insulating materials 200 and 300 may be required. Further, an insulating coating film may be formed on surfaces of the magnetic particles 201 and 301.

The first and second external electrodes 41 and 42 may be formed on external surfaces of the encapsulant 3 to be connected to both end portions of the first coil portion 11, in detail, the lead-out portion 101 of the first coil pattern 11*a* and the lead-out portion 102 of the second coil pattern 11*b*, respectively. Similarly, the third and fourth external electrodes 43 and 44 may be formed on external surfaces of the encapsulant 3 to be connected to both ends of the second coil portion 12, in detail, the lead-out portion 103 of the fourth coil pattern 12*b* and the lead-out portion 104 of the fourth coil pattern 12*b*, respectively. The first and second external electrodes 41 and 42 may be disposed to oppose each other with the encapsulant 3 interposed therebetween. Similarly, the third and fourth external electrodes 43 and 44 may be disposed to oppose each other with the encapsulant 3 interposed therebetween. Accordingly, the first external electrode 41 and the third external electrode 42 may be disposed adjacent to each other, and the second external electrode 42 and the fourth external electrode 44 may be disposed adjacent to each other.

The external electrodes 41, 42, 43, and 44 may be formed using a paste containing a metal having improved electrical conductivity, for example, a conductive paste including nickel (Ni), copper (Cu), silver (Ag), or alloys thereof. In addition, a plating layer may further be formed on each of the external electrodes 41, 42, 43, and 44. In this case, the plating layer may include at least one selected from the group consisting of nickel (Ni), copper (Cu), and tin (Sn). For example, a nickel layer and a tin May be sequentially formed.

As described above, the intermediate layer 2 including the magnetic particle 201 and the encapsulant 3 including the magnetic particle 301 have different permeabilities to each other, and the magnetic permeability thereof are appropriately set to adjust a coupling coefficient of the first and second coil portions 11 and 12. To adjust the permeabilities of the intermediate layer 2 and the encapsulant 3, a volume fraction of the first magnetic particles 201 included in the intermediate layer 2 (first volume fraction) and a volume fraction of the second magnetic particles 301 included in the encapsulant 3 (a second volume fraction) are different from each other. The term "volume fraction" of magnetic particles refers to a volume ratio of the first magnetic particles 201 with respect to the volume of the intermediate layer 2 or a volume of the second magnetic particles 301 with respect to the volume of the encapsulant 3. The first and second magnetic particles 201 and 301 may be implemented using the same material, for example, a metal alloy having the same composition to adjust a relative permeability of the intermediate layer 2 and the sealing material 3 with the volume fraction of the first and second magnetic particles 201 and 301.

The intermediate layer 2 may have permeability higher than a permeability of the encapsulant 3. To this end, the volume fraction of the first magnetic particles 201 included in the intermediate layer 2 may be greater than the volume fraction of the second magnetic particles 301 included in the encapsulant 3, as illustrated in FIG. 4. In the case in which the permeability of the intermediate layer 2 disposed between the first and second coil portions 11 and 12 is greater than the permeability of the encapsulant 3, a coupling coefficient of the first and second coil portions 11 and 12 may be relatively decreased, meaning that a coupling coefficient is decreased to be lower than a coupling coefficient in a case in which the permeabilities of the intermediate layer 2 and the sealing material 3 are equal to each other. In the case in which the permeability of the intermediate layer 2 is relatively high, the amount of a magnetic flux flowing to the intermediate layer 2 is increased. Thus, a mutual inductance generated by the magnetic flux shared by the first and second coil portions 11 is decreased. It will be appreciated that the magnetic flux flowing to the intermediate layer 2 flows through the intermediate layer 2 in an X direction in FIG. 3.

As a result, the mutual inductance of the first and second coil portions 11 and 12 is decreased, while leakage inductance generated only in the first coil portion 11 or the second coil portion 12 is increased. Therefore, the coupling coefficient of the first and second coil portions 11 and 12 is decreased. To adjust the coupling coefficient, the intermediate layer 2 may also be disposed in a region corresponding to a core region of the first and second coil portions 11 and 12.

Meanwhile, the magnetic permeability of the intermediate layer 2 may be less than the permeability of the encapsulant 3. To this end, the volume fraction of the first magnetic particles 202 included in the intermediate layer 2 may be smaller than the volume fraction of the second magnetic particles 302 included in the encapsulant 3. In the case in which the permeability of the intermediate layer 2 is less than the permeability of the encapsulant 3, the coupling coefficient of the first and second coil portions 11 and 12 may be relatively increased, as described above, meaning that the coupling coefficient is increased to be higher than a coupling coefficient in the case in which the permeabilities of the intermediate layer 2 and the encapsulant 3 are equal to each other. In the case in which the permeability of the intermediate layer 2 is relatively low, the amount of magnetic flux flowing to the intermediate layer 2 is relatively small and the mutual inductance generated by the magnetic flux shared by the first and second coil portions 11 and 12 is increased. As a result, the mutual inductance of the first and second coil portions 11 and 12 is increased, while the leakage inductance generated only in the first coil portion 11 or the second coil portion 12 is decreased. Therefore, the coupling coefficient of the first and second coil portions 11 and 12 is increased.

In a related art, a coupling coefficient of first and second coil portions is adjusted using a thickness of an intermediate layer, which results in a limitation in decreasing the thickness of the intermediate layer. Meanwhile, when the thickness of the intermediate layer is increased, a size of a component is increased. Similarly, to the present exemplary embodiment, in the case in which the magnetic permeability is controlled by changing the volume fractions of the magnetic particles included in the intermediate layer 2 and the encapsulant 3 to be different from each other, a coupling coefficient may be effectively controlled while maintaining the size of the intermediate layer 2 or the coil electronic component 100.

In Table (1), the inventors of the present disclosure showed how a coupling coefficient of first and second coil portions is varied by changing the magnetic permeabilities of the encapsulant and the intermediate layer. The first and second coil portions use the same shape in all three cases, and DC resistance characteristics Rdc thereof are equal to each other.

TABLE (1)

| Sample | Permeability of Encapsulant | Permeability of Intermediate Layer | Rdc (mohm) | Coupling Coefficient (k) |
|---|---|---|---|---|
| 1 | 30 | 30 | 224.03 | −0.48806 |
| 2 | 30 | 40 | 224.03 | −0.43684 |
| 3 | 30 | 20 | 224.03 | −0.55493 |

As can be seen from the results of Table (1), in the case in which an intermediate layer has permeability greater than permeability of an encapsulant (Sample 2), a coupling coefficient is smaller than a coupling coefficient in the case in which the coefficients are equal to each other (Sample 1), and is larger than a coupling coefficient in the case in which an intermediate layer has permeability less than permeability of an encapsulant (Sample 3). In Table (1), the coupling coefficients are negative, but are related to a direction of a turn formed by first and second coil portions. Accordingly, the coupling coefficients may be compared as absolute values thereof.

Figure 6:
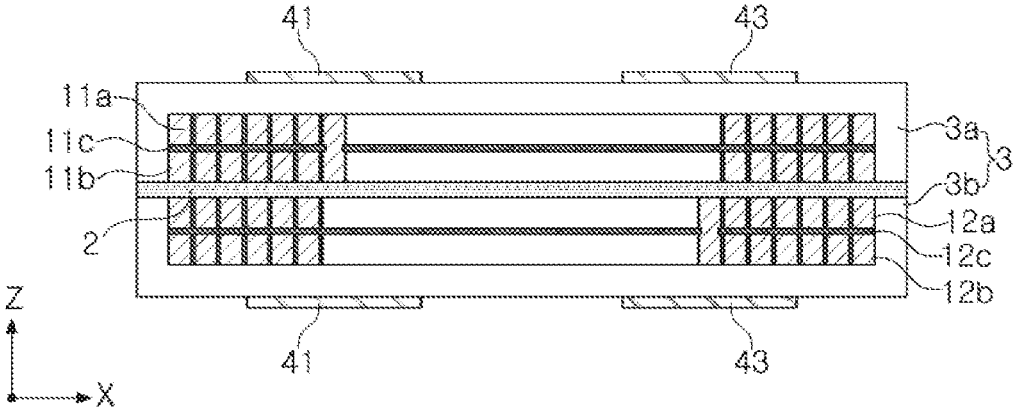
FIG. 6 illustrates a coil electronic component according to a modified embodiment in the present disclosure.

FIG. 6 shows a coil electronic component according to a modified embodiment. Hereinafter, only a lead-out pattern, which is a modified component, will be described. In the case of the coil electronic component according to the modified embodiment in FIG. 6, an intermediate layer 2 has a shape dividing an encapsulant 3 into two regions. Specifically, the intermediate layer 2 extends in a direction of external surfaces of the first and second coil portions 11 and 12 in such a manner that side surface of the intermediate layer 2 are exposed externally of the encapsulant 3. For example, the intermediate layer 2 is not formed only in the first and second coil portions 11 and 12 and a neighboring region thereof but is extended to the entire region of the coil electronic component. The two regions of the encapsulant 3 divided by the intermediate layer 2 may be separate from each other. When an intermediate layer 2 having such an extended shape is used, a coupling coefficient of the first and second coil portions 11 and 12 may more effectively adjusted by adjusting the permeability of the intermediate layer 2.

As the intermediate layer 2 has the extended shape, the encapsulant 3 may include a first encapsulant 3*a*, encapsulating the first coil portion 11, and a second coil portion 3*b* encapsulating the second coil portion 12. In this case, the first and second encapsulants 3*a* and 3*b* may have the same permeability or different permeabilities from each other. The permeabilities of the first and second encapsulants 3*a* and 3*b* may be adjusted to appropriately set characteristics of the respective first and second coil portions 11 and 12 and a mutual coupling coefficient thereof.

A shape, in which the encapsulant 3 includes first and second encapsulants 3*a* and 3*b*, is described only in FIG. 6, but the present embodiment may be applied to the above-described embodiment, for example, a structure in which the intermediate layer 2 is disposed respectively only in peripheral regions of the first and second coil portions.

As described above, permeabilities of an encapsulant and an intermediate layer may be adjusted to effectively adjust a coupling coefficient between coil portions in a coil electronic component having a coupled inductor structure.

While exemplary embodiments have been shown and described above, it will be apparent to those skilled in the art that modifications and variations could be made without departing from the scope of the present invention as defined by the appended claims.

What is claimed is:

1. A coil electronic component comprising:

first and second coil portions magnetically coupled to each other;

an intermediate layer disposed between the first and second coil portions, the intermediate layer including first magnetic particles therein; and an encapsulant encapsulating the first and second coil portions and including second magnetic particles, wherein the intermediate layer and the encapsulant have permeabilities different from each other, and wherein the first magnetic particles comprise metal and include particles having different sizes from each other.

2. The coil electronic component of claim 1, wherein the permeability of the intermediate layer is greater than the permeability of the encapsulant.

3. The coil electronic component of claim 1, wherein the permeability of the intermediate layer is less than the permeability of the encapsulant.

4. The coil electronic component of claim 1, wherein the intermediate layer includes the first magnetic particles in a first volume fraction, where the first volume fraction refers to a volume ratio of the first magnetic particles with respect to a volume of the intermediate layer, the encapsulant includes the second magnetic particles in a second volume fraction, where the second volume fraction refers to a volume ratio of the second magnetic particles with respect to a volume of the encapsulant, and the first and second volume fractions are different from each other.

5. The coil electronic component of claim 4, wherein the first volume fraction is greater than the second volume fraction, and the permeability of the intermediate layer is greater than the permeability of the encapsulant.

6. The coil electronic component of claim 4, wherein the first volume fraction is less than the second volume fraction, and the permeability of the intermediate layer is less than the permeability of the encapsulant.

7. The coil electronic component of claim 1, wherein the first magnetic particles and the second magnetic particles are metal alloys having the same composition.

8. The coil electronic component of claim 1, further comprising:

first and second external electrodes disposed on external surfaces of the encapsulant to be connected to both ends of the first coil portion; and third and fourth external electrodes disposed on external surfaces of the encapsulant to be connected to both ends of the second coil portion.

9. The coil electronic component of claim 1, wherein the first coil portion has a structure in which a plurality of coil patterns are laminated.

10. The coil electronic component of claim 9, wherein an insulating layer is interposed between the plurality of coil patterns of the first coil pattern, and the plurality of coil patterns of the first coil pattern are connected to each other by at least one via.

11. The coil electronic component of claim 1, wherein the second coil portion has a structure in which a plurality of coil patterns are laminated.

12. The coil electronic component of claim 11, wherein an insulating layer is interposed between the plurality of coil patterns of the second coil pattern, and the plurality of coil patterns of the second coil pattern are connected to each other by at least one via.

13. The coil electronic component of claim 1, wherein the encapsulant includes a first encapsulant, encapsulating the first coil portion, and a second encapsulant encapsulating the second coil portion.

14. The coil electronic component of claim 13, wherein the first and second encapsulants have different permeabilities to each other.

15. The coil electronic component of claim 1, wherein the intermediate layer has a shape dividing the encapsulant into two regions.

16. The coil electronic component of claim 15, wherein the intermediate layer extends in a direction of external surfaces of the first and second coil portions in such a manner that side surfaces of the intermediate layer are exposed externally of the encapsulant.

17. The coil electronic component of claim 15, wherein the two regions of the encapsulant divided by the intermediate layer are separate from each other.

18. The coil electronic component of claim 1, wherein the intermediate layer is disposed in a region corresponding to a core region of the first and second coil portions.

19. The coil electronic component of claim 1, wherein the first coil portion includes a first coil pattern extending from one end of the first coil portion to another end of the first coil portion entirely on one side of the intermediate layer, and wherein the second coil portion includes a second coil pattern extending from one end of the second coil portion to another end of the second coil portion entirely on another side of the intermediate layer.

* * * * *